US006637438B1

(12) United States Patent
Lane

(10) Patent No.: US 6,637,438 B1
(45) Date of Patent: Oct. 28, 2003

(54) METHOD FOR ASSAY AND REMOVAL OF HARMFUL TOXINS DURING PROCESSING OF TOBACCO PRODUCTS

(76) Inventor: Kerry Scott Lane, 621 Andrews Ave., Del Ray Beach, FL (US) 33483

( * ) Notice: Subject to any disclaimer, the term of this patent is extended or adjusted under 35 U.S.C. 154(b) by 0 days.

(21) Appl. No.: 09/471,384

(22) Filed: Dec. 23, 1999

Related U.S. Application Data

(63) Continuation of application No. 09/033,000, filed on Mar. 2, 1998, now Pat. No. 6,058,940.

(60) Provisional application No. 60/043,736, filed on Apr. 21, 1997, and provisional application No. 60/045,569, filed on May 5, 1997.

(51) Int. Cl.[7] ..... A24B 15/22; A24B 3/10; A24B 15/28

(52) U.S. Cl. ..... 131/290; 131/299; 131/300; 131/309

(58) Field of Search ..... 131/299, 290, 131/297, 370, 298, 300, 309, 310

(56) References Cited

U.S. PATENT DOCUMENTS

| | | | | |
|---|---|---|---|---|
| 3,429,709 A | | 2/1969 | Merle et al. | |
| 3,494,723 A | * | 2/1970 | Gray | 131/299 |
| 3,631,865 A | | 1/1972 | Michelson | |
| 3,763,374 A | | 10/1973 | Tiffany et al. | |
| 3,863,645 A | | 2/1975 | Tso | |
| 3,992,631 A | | 11/1976 | Harte | |
| 4,036,946 A | | 7/1977 | Kleinerman | |
| 4,055,674 A | | 10/1977 | Yano et al. | |
| 4,071,315 A | | 1/1978 | Chateau | |
| 4,126,701 A | | 11/1978 | Taylor | |
| 4,168,146 A | | 9/1979 | Grubb et al. | |
| 4,181,853 A | | 1/1980 | Abu-Shumays et al. | |
| RE30,386 E | | 8/1980 | Brandt et al. | |
| 4,270,553 A | | 6/1981 | Conrad et al. | |
| 4,285,698 A | | 8/1981 | Otto et al. | |
| 4,314,027 A | | 2/1982 | Stahr | |
| 4,497,330 A | | 2/1985 | Banyasz et al. | |
| 4,523,598 A | | 6/1985 | Weiss et al. | |
| 4,531,529 A | | 7/1985 | White et al. | |
| 4,572,723 A | | 2/1986 | Ward | |
| 4,772,551 A | | 9/1988 | Hart et al. | |
| 4,795,651 A | | 1/1989 | Henderson et al. | |
| 4,835,100 A | | 5/1989 | Dixon et al. | |
| 4,866,283 A | | 9/1989 | Hill, Jr. | |
| 4,887,618 A | | 12/1989 | Bernasek et al. | |
| 4,944,316 A | | 7/1990 | Stuhl et al. | |
| 4,962,774 A | | 10/1990 | Thomasson et al. | |
| 4,991,598 A | | 2/1991 | Henderson et al. | |
| 5,068,359 A | * | 11/1991 | Huxley et al. | 549/58 |
| 5,082,679 A | | 1/1992 | Chapman | |
| 5,139,035 A | | 8/1992 | Lasch et al. | |
| 5,178,832 A | | 1/1993 | Phillips et al. | |
| 5,194,161 A | | 3/1993 | Heller et al. | |
| 5,230,160 A | | 7/1993 | Gross et al. | |
| 5,294,442 A | | 3/1994 | Cotty | |
| 5,301,694 A | | 4/1994 | Raymond et al. | |
| 5,306,466 A | | 4/1994 | Goldsmith | |
| 5,322,799 A | | 6/1994 | Miller et al. | |
| 5,362,442 A | | 11/1994 | Kent | |
| 5,472,001 A | | 12/1995 | Nicholson | |
| 5,487,998 A | | 1/1996 | Umrigar et al. | |
| 5,498,431 A | | 3/1996 | Lindner | |
| 5,510,104 A | | 4/1996 | Allen | |
| 5,584,989 A | | 12/1996 | Jameson | |
| 5,603,972 A | | 2/1997 | McFarland | |
| 5,639,794 A | * | 6/1997 | Emerson et al. | 514/699 |
| 5,679,362 A | | 10/1997 | Miller et al. | |
| 5,698,599 A | * | 12/1997 | Subbiah | 514/703 |
| 5,803,081 A | * | 9/1998 | O'Donnell, Jr. et al. | 131/299 |

OTHER PUBLICATIONS

Cordesman,Anthony H.; "Weapons of Mass Destruction in Iraq"; Study Prepared by the Center for Strategic and International Studies, Nov. 14, 1996.

Collet, J.P., et al., "Parental Smoking and Risk of Otitis Media in Pre–school Children." Canadian Journal of Public Health, Jul.–Aug., 1995; 86(4): 269–273.

Cepeda, A., et al., "Postcolumn Excitation of Aflatoxins Using Cyclodextrins in Liquid Chromatography for Food Analysis." Journal of Chromatography, 1996; 721: 69–74.

Denning, D.W., "Aflatoxin and Outcome from Acute Lower Respiratory Infection in Children in the Philippines." Annals of Tropical Paediatrics, 1995; 15: 209–216.

Dvorackova, Ivana, M.D. "Aflatoxin Inhalation and Alveolar Cell Carcinoma." British Medical Journal, Mar. 20, 1976; 691.

El–Maghraby, O.M. and M.A. Abdel–Sater, "Mycoflora and Natural Occurrence of Mycotoxins from Cigarettes in Egypt." Zentralblatt fur Mikrobiologie, 1993; 148(4): 253–264.

Eaton, David L., and John D. Groopman, The Toxicology of Aflatoxins, Academic Press, New York, 1994. (Abstract only).

Hamilton, P.B., G.B. Lucas and R.E. Welty, "Mouse Toxicity of Fungi of Tobacco." Applied Microbiology, Oct., 1968; 18: 570–574.

(List continued on next page.)

*Primary Examiner*—Dionne A. Walls
(74) *Attorney, Agent, or Firm*—Bradford E. Kile; Kile Goekjian Lerner & Reed

(57) ABSTRACT

A process and system for continuous assay and removal of toxins from tobacco. Products such as tobacco contaminated with mycotoxins, particularly aflatoxins, and benzpyrene and its precursors, are subjected to treatment, generally in a solvent medium, to decontaminate the tobacco of the toxin. Continuous monitoring of all harmful toxins eluted from the cleaning solvent is performed by immunoantibody ultraviolet fluorescence, for example. A quality, control process ensures removal of harmful toxins from tobacco before further processing. Decontamination of extracted solvent streams and re-additives ensures safe reuse or disposal of the solvents and re-additives.

4 Claims, 6 Drawing Sheets

OTHER PUBLICATIONS

Haugland, Richard P., Handbook of Fluorescent Probes and Research Chemicals, Sixth Ed. Molecular Probes, Inc., Eugene, Oregon, 1996 (Cover and Table of Contents).

Lofroth, Goran and Yngve Zebuhr, "Polychlorinated Dibenzo–p–dioxins (PCDDs) and Dibenzofurans (PCDFs) in Mainstream and Sidestream Cigarette Smoke". Bulletin of Environmental Contamination Toxicology, 1992.

Ma, Xinfang, Jacqueline A. Gibbons and John G. Babish, "Benzo (e) pyrene Pretreatment of Immature, Female C57BL/6J Mice Results in Increased Bioactivation of Aflatoxin B1 in Vitro". Toxicology Letters, 1991; 59.

Pattee, Harold E., "Production of Aflatoxins by Aspergillus Flavus Cultured in Flue–Cured Tobacco". Applied Microbiology, Nov., 1969; 18: 952–953.

Stubblefield, R.D., J.I. Greer, O.L. Shotwell, and A.M. Aikens, "Rapid Immunochemical Screening Method for Aflatoxin B1 in Humans and Animal Urine" JOAC 1991; 74: 530.

Vlahov, David, Ph.D., et al., "Prognostic Indicators for AIDS and Infectious Disease Death in HIV–Infected Injection Drug Users: Plasma Viral Load and CD4+ Cell Count." JAMA, Jan. 7, 1998; 279 (1): 35–40.

Welty, R.E., G.B. Lucas, J.T. Fletcher, and H. Yang, "Fungi Isolated from Tobacco Leaves and Brown–Spot Lesions Before and After Flue–Curing." Applied Microbiology, Sep., 1968; 16: 1309–1313.

Welty, R.E. and G.B. Lucas, "Fungi Isolated from Flue–Cured Tobacco at Time of Sale and After Storage." Applied Microbiology, Mar., 1969; 17: 360–365.

Yao, Yan, Amy Hoffer, Ching–yi Chang, and Alvaro Puga, "Dioxin Activates HIV–1 Gene Expression by an Oxidative Stress Pathway Requiring a Functional Cytochrome P450 CYP1A1 Enzyme." Environmental Health Perspectives, Mar., 1995; 103: 366–371.

Varma, S. K. et al., Ecotoxicological aspects of Asperigilli present in the phylloplane of stored leaves of chewing tobacco (Nicotiana tobaccum), Mycopathologia 113: 19–21, 1991.

Tso, T.C. et al., Examination of Aflatoxin B1 in Leaf Tobacco and in Cigarette Smoke Condensate, Beitrage zur Tabakforschung, Band 4, Heft 1, Aug. 1967.

Langer et al., Inorganic__, p. 430.

* cited by examiner

METHOD FOR ASSAY AND REMOVAL OF HARMFUL TOXINS DURING PROCESSING OF TOBACCO PRODUCTS

This application is a con for patent claims the benefit of United States U.S. patent application Ser. No. 09/033,000 file date Mar. 2, 1998, now U.S. Pat. No. 6,058,940 which claims the benefit of U.S. Provisional Application Serial No. 60/043,736 filed Apr. 21, 1997 and U.S. Provisional Application Serial No. 60/045,569 filed May 5, 1997.

BACKGROUND OF THE INVENTION

The present invention relates to an improved process and apparatus for detecting and removing harmful toxins, such as mycotoxins and benzpyrene (BZP), found in tobacco and tobacco products to ensure that the products are safe for human association and/or consumption. More specifically, the invention relates to a novel process and apparatus for continuously detecting, monitoring and removing harmful mycotoxins, in particular, but not limited to aflatoxins, and benzpyrene and its precursors, during processing of tobacco for human association, consumption and use. Moreover, the novel process and apparatus provides for inhibiting production of harmful toxins in tobacco and tobacco products, and for continuous monitoring and removal of such toxins from solvent and gaseous effluent streams arising from processing tobacco.

Since at least as earl as the 1980's, an increasing concern about public safety has led tobacco processors and refiners to attempt to reduce the tar content of cigarettes. It was this concern about consumer safety that resulted in research in the field of tobacco treatments for manufacturing reformulated tobacco with lower tar. U.S. Pat. No. 4,944,316 to Stuhl et al., entitled "Process for Treating Tobacco and Similar Organic Materials."

It is believed that safety initiatives by the tobacco companies, however, have only recently addressed some of the most potent carcinogens: mycotoxins. A class of mycotoxins, commonly known as aflatoxins, is one of the most potent carcinogens known to man. Eaton, David L., and John D. Groopman, *The Toxicology of Aflatoxins*, Academic Press, N.Y. 1994. Aflatoxins are estimated to be 200 times more carcinogenic than benzpyrene, the most regularly acknowledged carcinogen in tobacco smoke. Moreover, benzpyrene pre-treatment of some species has been associated with an increase in bioactivity of aflatoxins. Ma, Xinfang, Jacqueline A. Gibbons and John G. Babish. "Benzo|e|pyrene Pretreatment of Immature. Female C57BL/6J Mice Results in Increased Bioactivation of Aflatoxin $B_1$ in Vitro." *Toxicology Letters*, 1991: 59: 51–58.

Additionally. Aflatoxins have been shown to be profound immunosuppressants. Denning, D. W., "Aflatoxin and Outcome from Acute Lower Respiratory Infection in Children in the Philippines." *Annals of Tropical Paediatrics*, 1995; 15: 209–216. A 400% increase in the titers of human immunodeficiency virus (HIV) occurs when exposed to aflatoxin. Yao, Yan, Amy Hoffer Ching-yi Chang, and Alvaro Puga, "Dioxin Activates HIV-1 Gene Expression by an Oxidative Stress Pathway Requiring a Functional Cytochrome P450 CYP1A1 Enzyme." Enivronmental Health *Perspectives*, March 1995; 103: 366–371.

The potency of aflatoxins is further illustrated by its presence as one of the chemical agents in Iraq's arsenal of chemical weapons. See a study by Anthony H. Cordesman co-director of the Middle East Program at the Center for Strategic and International Studies, entitled "Weapons of Mass Destruction in Iraq" (Nov. 14, 1996).

It has been observed that many tumor types found in experimental animals that arc exposed to aflatoxins are the same as the tumor types found in cigarette smokers. As is well known, tobacco use has been associated with an increased incidence of many cancers, typically cancer of the lung, esophagus, mouth, throat, stomach, colon, kidney, bladder, and breast, among others. The presence of mycotoxins, such as aflatoxins, on tobacco may be a cause of the high incidence of cancer associated directly and indirectly with cigarette smoking. Dvorackova, Ivana, M.D. "Aflatoxin Inhalation and Alveolar Cell Carcinoma." *British Medical Journal*, Mar. 20, 1976; 691. El-Maghraby, O. M. and M. A. Abdel-Sater, "Mycoflora and Natural Occurrence of Mycotoxins from Cigarettes in Egypt." *Zentralblatt fur Mikrobiologie*, 1993; 148(4): 253–264.

In addition to danger to a cigarette smoker by the presence of aflatoxins in primary cigarette smoke, aflatoxins may be a special hazard in secondhand smoke. Both aflatoxins, which are dihydrobenzofurofurans, and benzpyrene, are aromatic heterocyclics, which means they are relatively stable. Therefore, although some aflatoxins present in tobacco may be combusted at the combustion temperatures that are produced when a cigarette is burnt by inhaling at one end, aflatoxins have been shown under some smoking conditions especially idling of a burning cigarette, to survive the combustion process. Lofroth, Goran and Yngve Zebuhr, "Polychlorinated Dibenzo-p-dioxins (PCDDs) and Dibenzofurans (PCDFs) in Mainstream and Sidestream Cigarette Smoke." *Bulletin of Environmental Contamination Toxicology* 1992; 48: 789–794. As secondhand smoke is often combusted at lower temperatures than primary smoke, a larger proportion of aflatoxins may remain undestroyed in secondhand smoke, posing an environmental danger to others. In at least one study, passive or secondary smoke has been linked to repeated occurrences of acute otitis media among pre-school children. Collet. J. P., et al., "Parental Smoking and Risk of Otitis Media in Pre-school Children." *Canadian Journal of Public Health*, July–August, 1995; 86(4): 269–273.

Inhalation of primary or secondhand smoke contaminated with aflatoxins may be inadvertently increasing titers of HIV in individuals thus exposed; for example, pregnant women with HIV, thus increasing the chances of infecting their offspring. Yao, Yan, supra; and Vlahov, David, Ph.D., et al., "Prognostic Indicators for AIDS and Infectious Disease Death in HIV-Infected Injection Drug Users: Plasma Viral Load and $CD4^+$ Cell Count." *JAMA*, Jan. 7, 1998; 279 (1): 35–40.

These potent health hazards are produced by the Aspergillus and Penicillium fungi, among others, and were known to be present in tobacco and tobacco products since at least the 1960's. Pattee, Harold E., "Production of Aflatoxins by *Aspergillus flavus* Cultured on Flue-Cured Tobacco." *Applied Microbiology*, November, 1969; 18: 952–953; Welty, R. E., G. B. Lucas, J. T. Fletcher, and H. Yang, "Fungi Isolated from Tobacco Leaves and Brown-Spot lesions Before and After Flue-Curing." *Applied Microbiology*, September 1968; 16: 1309–1313; Hamilton, P. B., G. B. Lucas and R. E. Welty, "Mouse Toxicity of Fungi of Tobacco." *Applied Microbiology*, October, 1968; 18: 570–574.; and Welty, R. E. and G. B. Lucas, "Fungi Isolated from Flue-Cured Tobacco at Time of Sale and After Storage." *Applied Microbiology*, March, 1969; 17: 360–365. However, the significance and potential health hazard of aflatoxins were not considered by the tobacco industry until now. In a 1997 U.S. Patent to Subbiah, entitled "Method of Inhibiting Mycotoxin Production," U.S. Pat. No. 5,698,599, and assigned on its face to the R. J. Reynolds Tobacco Company, a method is disclosed for inhibiting mycotoxin production in tobacco.

Mycotoxins in general, and aflatoxins in particular, are monitored and controlled in agricultural feed and foodstuffs to minimize their impact. Current Food and Drug Administration (FDA) regulations ban use of aflatoxin-contaminated corn and grain when aflatoxin levels exceed 20 parts per billion (ppb). Similar regulations apply for other mycotoxins. Yet, due to lack of FDA authority, no regulations presently exist to mandate permissible levels of these toxins on tobacco products, both for chewing and smoking. Presently there is no regulatory oversight to ensure that tobacco and tobacco products consumed by the public are adequately screened and treated for mycotoxins such as aflatoxins, and benzpyrene. Furthermore, there is no publicly available information which reveals that adequate measures are being taken by the tobacco industry to monitor, treat and remove these potent toxins from tobacco and tobacco products.

Treatment of tobacco to reduce such harmful toxins is of critical importance. Monitoring the production process to ensure continuous diminution is of equal importance. A failure to adequately monitor, treat and remove these harmful toxins could result in their continued presence in tobacco and tobacco products with attendant negative public health consequences.

Prior art tobacco treatment processes do not fully acknowledge or address the implications of mycotoxins (such as aflatoxins) on tobacco leaves, and therefore, the prior art processes do not adequately monitor or treat the toxins. Reformulation and reconstitution processes currently used in cigarette manufacturing appear to mimic many of the known processes for removing mycotoxins, especially Aflatoxins, from agricultural products. U.S. Pat. No. 5,082,679 to Chapman, entitled "Method for Detoxifying Foodstuffs": U.S. Pat. No. 4,962,774 to Thomasson et al., entitled "Tobacco Reconstitution Process": U.S. Pat. No. 4,531,529 to White et al., entitled "Process for Increasing Filling Capacity of Tobacco": and U.S. Pat. No. 4,055,674 to Yano et al., entitled "Method for the Removal of Aflatoxin from Cereals, Oil Seeds and Feedstuffs." However, these processes do not disclose continuously assaying and treating in-process tobacco to ensure adequate removal and continuous diminution of harmful toxins, such as mycotoxins and benzpyrene, from tobacco and tobacco end products.

OBJECTS AND BRIEF SUMMARY OF THE INVENTION

It is therefore a general object of the invention to provide a novel process and system, which will minimize a potent toxin in tobacco, a toxin with negative public-health consequences.

It is another general object of the invention to provide a novel process and system that inhibits production of and greatly reduces levels of harmful toxins in tobacco products.

It is another general object of the invention to provide a novel process and system for continuous analysis and treatment of harmful toxins during processing of tobacco products.

It is another general object of the invention to provide a novel process and system for continuous monitoring of a wide array of harmful toxins during processing of tobacco to detect and eliminate in-process product having unacceptably high levels of toxins.

It is another general object of the invention to provide a novel process and system, which can be utilized for a wide range of tobacco products with respect to which microbial toxin detection and removal is desirable or necessary.

It is a specific object of the invention to provide for continuous assay and analysis and removal of harmful toxins, such as mycotoxins and benzpyrene, from tobacco during processing for human and animal consumption and use.

It is another specific object of the invention to provide a novel process and system for continuous assay and analysis and removal of harmful toxins from solvent and gaseous extraction streams and other processing steps.

It is another specific object of the invention to provide a novel process and system for treating tobacco prior to processing to inhibit production of harmful toxins and to monitor and ensure the absence of harmful levels of the toxins in final end products.

It is another specific object of the invention to provide a novel process and system for removing harmful toxins from tobacco processing solvent or gaseous effluent streams so that the toxin-free solvents or gases are safe for reuse or disposal.

It is another specific object of the invention to provide a novel process and system for making tobacco inert with respect to production and reformation of harmful toxins.

BRIEF SUMMARY OF PREFERRED EMBODIMENTS OF THE INVENTION

Preferred embodiments of the invention that are intended to accomplish at least some of the foregoing objects comprise a process and system for storage, handling, and processing of tobacco in a cigarette manufacturing facility. Production of harmful toxins is inhibited, and harmful toxins that are present are continuously monitored, detected, and eliminated. The invention provides a process and system for continuous assay and treatment of toxins in an in-process product by contacting the product faith a solvent. The solvent is extracted and assayed for toxin content. The in-process product is again contacted with a solvent if the assayed toxin content exceeds a predetermined level of toxin. The solvent contacting, extracting and assaying steps are repeated until the assayed toxin content does not exceed a predetermined level of harmful toxin.

In one preferred embodiment of the invention, the in-process product is intended for human and animal consumption and use, such as tobacco. The toxin is a mycotoxin, and in particular an aflatoxin, or benzpyrene and its precursors. The process and system further comprises remediating the extracted solvent to remove harmful toxin and reusing the remediated solvent. Advantageously, the assaying is done by chromatography, including high-pressure liquid chromatography (HPLC), reversed-phase liquid chromatography, thin-laver chromatography, adsorption chromatography, immunoaffinity chromatography, gas chromatography; enzyme-linked immunoadsorbent assay (ELISA), fluorescent immunoassay, radioimmunoassay; spectroscopy, including mass spectroscopy, infrared spectroscopy, raman spectroscopy, packed-cell fluorescent spectroscopy; polymerase chain reaction (PCR), electron-capture decay (ECD), supercritical fluid extraction, bioluminescence, chemical luminescence, and combinations thereof. Fluorescent immunoassay is a presently preferred best mode for assaying for aflatoxin on tobacco.

The process and system provides for monitoring toxin content to less than 300 parts per billion (ppb), in particular, less than 20 parts per billion (ppb), and more particularly, less than 0.5 parts per billion (ppb). The process and system also provides for treating in-process product to inhibit production and reformation of toxin. Advantageously, in-process product is treated prior to processing with irradiation to sterilize the product; with an inert gas environment; or with non-toxigenic fungal spores to inhibit toxin production.

In another embodiment, the process includes heating in-process product, and collecting and analyzing vapors emitted from the heated product to determine toxin content in the product. Product that has toxin content greater than 300 parts per billion (ppb) is separated from product that has toxin content less than 300 parts per billion (ppb) to eliminate grossly contaminated product.

The process and system provides for detecting toxin contamination in an in-process product and separating contaminated product. Conveying means is used for conveying in-process product to means for retaining in-process product for illumination by, ultraviolet light. Detector means detects fluorescence emitted from in-process product illuminated by the ultraviolet light indicative of toxin content. Preferably, computer means may be used for controlling the retaining means to retain product for further processing when no fluorescence is detected and to discharge product when fluorescence indicative of toxin is detected.

DRAWINGS

Other objects and advantages of the present invention will become apparent from the following detailed description of preferred embodiments thereof taken in conjunction with the accompanying drawings, wherein.

DETAILED DESCRIPTION

Figure 1:
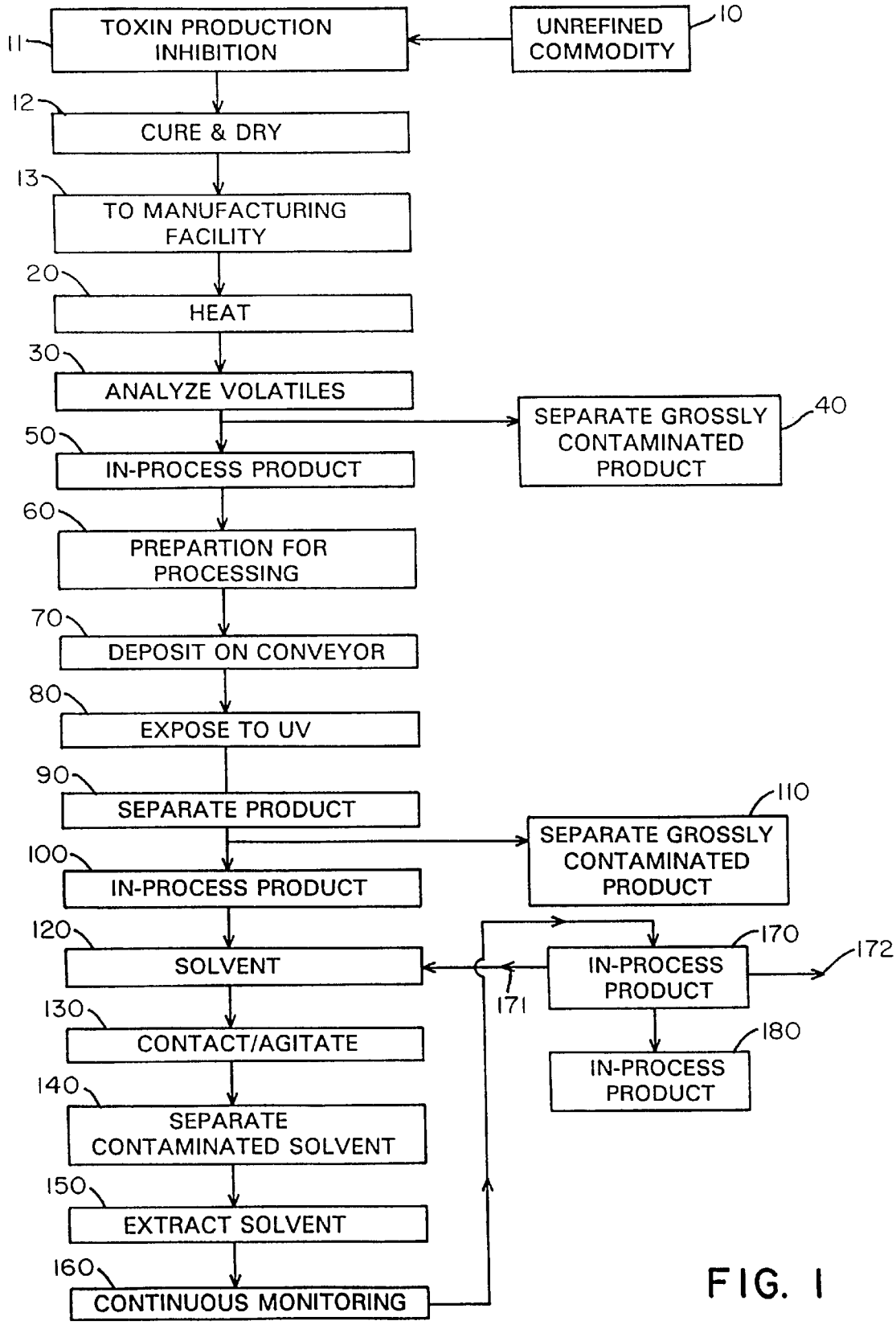
FIG. 1 is a schematic diagram of process steps representative of one embodiment of the present invention.

The process and system of the invention provides a product that contains minimal amounts of harmful toxins, such as mycotoxins and benzpyrene, in the final end products, such as tobacco products. Tobacco leaves are particularly suited for the process and system of the invention. Tobacco strips, shredded tobacco, diced tobacco, tobacco rag, tobacco plant extracts, tobacco nicotine extracts, or any other tobacco-based product—all are considered within the scope of the invention.

As used herein, the terms "tobacco" and "tobacco products" mean all tobacco and nicotine-based products intended for human and animal consumption, association and/or use, which may be contaminated with toxigenic microbial contaminants, and in particular, immunosuppressive and carcinogenic toxins. The term "in-process product" means any product or commodity that is to be or is being processed for human and animal consumption or use. The term "grossly contaminated product" means any product that is found to be contaminated, based upon visual examination, irradiation with ultraviolet light, measurement of moisture content, or any other general examination, such that the contamination cannot be removed or treated as a practical matter. The terms "toxins" and "harmful toxins" include mycotoxins, such as aflatoxins, ochratoxins, which are produced by Aspergillus ochraeus and are both nephrotoxins and promoters of lung tumors, zearealone, an estrogenic carcinogen, produced by the fungi species fusarium, which is known in particular to contaminate tobacco, and other mycotoxins that are known to be produced by a variety of fungi that regularly inhabit tobacco depending on the microenvironment; the at least 40 other carcinogens known to exist in tobacco, the prototypical being benzpyrene; and other compounds such as tobacco-specific nitrosamines, which may be detected by optical fluoroscopy in solvent streams, and as such are amenable to a treatment process to remove them.

In its broadest aspect, the present invention is directed to reducing contamination in tobacco and tobacco products by inhibiting production of harmful microbes, and in particular phytopathogenic fungi, and continuously monitoring and removing contamination from products, such as tobaccos which are prone to contamination by phytopathogenic fungi that produce toxic metabolites known as mycotoxins, and other harmful toxins. Contamination is reduced at each stage of a production process including storage, pre-processing, and during actual processing into end product. Of importance are mycotoxins such as aflatoxin, tricothecene mycotoxins, ochratoxins, rubratoxins, patulin, stachybotrys, T2 toxins, sterigmatocystin, fusarium-based toxins; benzpyrene and its precursors; and other toxins and contaminants typically found in tobacco and tobacco products.

In-process product determined to be grossly contaminated is continuously eliminated from further processing. The products are treated to prevent production of harmful microbes and are continuously monitored during processing into products for human and animal consumption and/or use to detect and remove known harmful toxins. Pre- and post-production treatments of the products provide added protection against microbial growth and remediation of solvents and other agents used in processing permits safe reuse or disposal of the solvents/agents.

In particular, the process and system of the invention is directed to detecting, monitoring and removing one of the most dangerous of the mycotoxins known to man: a class of toxins commonly referred to as aflatoxins. The process includes continuously assaying or testing effluent streams derived from processing the commodity to monitor levels of aflatoxins in the effluent streams. This continuous assaying ensures a minimal presence of harmful toxins in final end products. The subject invention is particularly applicable to tobacco and products such as cigarettes because it provides a continuous monitoring and treating process and system for application in tobacco processing and manufacturing facilities.

The invention is also directed to detecting, monitoring and removing benzpyrene and its precursors. With respect to benzpyrene, see U.S. Pat. No. 3,863,645 to Tso, entitled "Process for Treating Tobacco."

Refer now to the drawings and particularly to FIG. 1, which shows that a commodity 10, such as unrefined tobacco material, is treated prior to processing to inhibit toxin production 11. The unrefined tobacco is placed in a storage facility 12, to cure and dry. This step of curing and driving typically occurs prior to transport to a manufacturing facility, such as a cigarette manufacturing facility, for processing into an end product. The tobacco product 10 may be washed post-harvesting with a detergent or other suitable cleansing solution to remove debris, pesticides, fungicides, etc., and placed on a conveying device for irradiation with gamma, x-ray or electron-beam radiation in a dose sufficient to sterilize most microbial contaminants. Typically, electron-beam irradiation in the range of about 1.5 kilograys (Kgys) or less is used within an energy range of about 0.5 to about 2.0 Mev to penetrate thin material less than 1 cm. thick. A 1997 United States Patent to McFarland entitled "Irradiation Method and Apparatus," U.S. Pat. No. 5,603,972, discloses an irradiation method and apparatus. The disclosure of that patent and all other references cited and/or discussed herein is hereby incorporated herein by reference as though set forth at length.

Alternatively gamma radiation in the range of 20 to 30 Kgys is used for thicker products. A 1994 United States Patent to Kent entitled "Method for Sterilizing Products with Gamma Radiation," U.S. Pat. No. 5,362,442, discloses a method for sterilizing products with gamma irradiation and the disclosure of that patent is also incorporated herein by reference. Since fungal spores are more resistant to radiation, a dose of 50–75 Kgys should be effective. As an alternative to irradiation, the product 10 may be treated with a suitable sporicidal composition. A United States Patent to Allen entitled "Method for Killing or Inhibiting the Growth of Sporulating Microorganisms with Haloperoxidase-Containing Compositions," U.S. Pat. No. 5,510,104, discloses one method for such treatment and its disclosure is incorporated herein by reference as though set forth at length.

A step to separate grossly contaminated product at this stage involves removing a known volume of product 10 and weighing it before further processing. If certain threshold weights are exceeded, moisture in the product could be excessive and a likelihood of fungal content is increased. Generally, aflatoxin formation is found to occur only when relative humidity exceeds about 85%, or when moisture content of the commodity exceeds about 18%. Pattee, Harold E. "Production of Aflatoxins by Aspergillus Flavus Cultured on Flue-Cured Tobacco." *Applied Microbiology*, November, 1969; 18: 952–953. Hence. such grossly contaminated product may be rejected at the outset. The weighing process is preferably done on a continuous conveyor.

Figure 2:
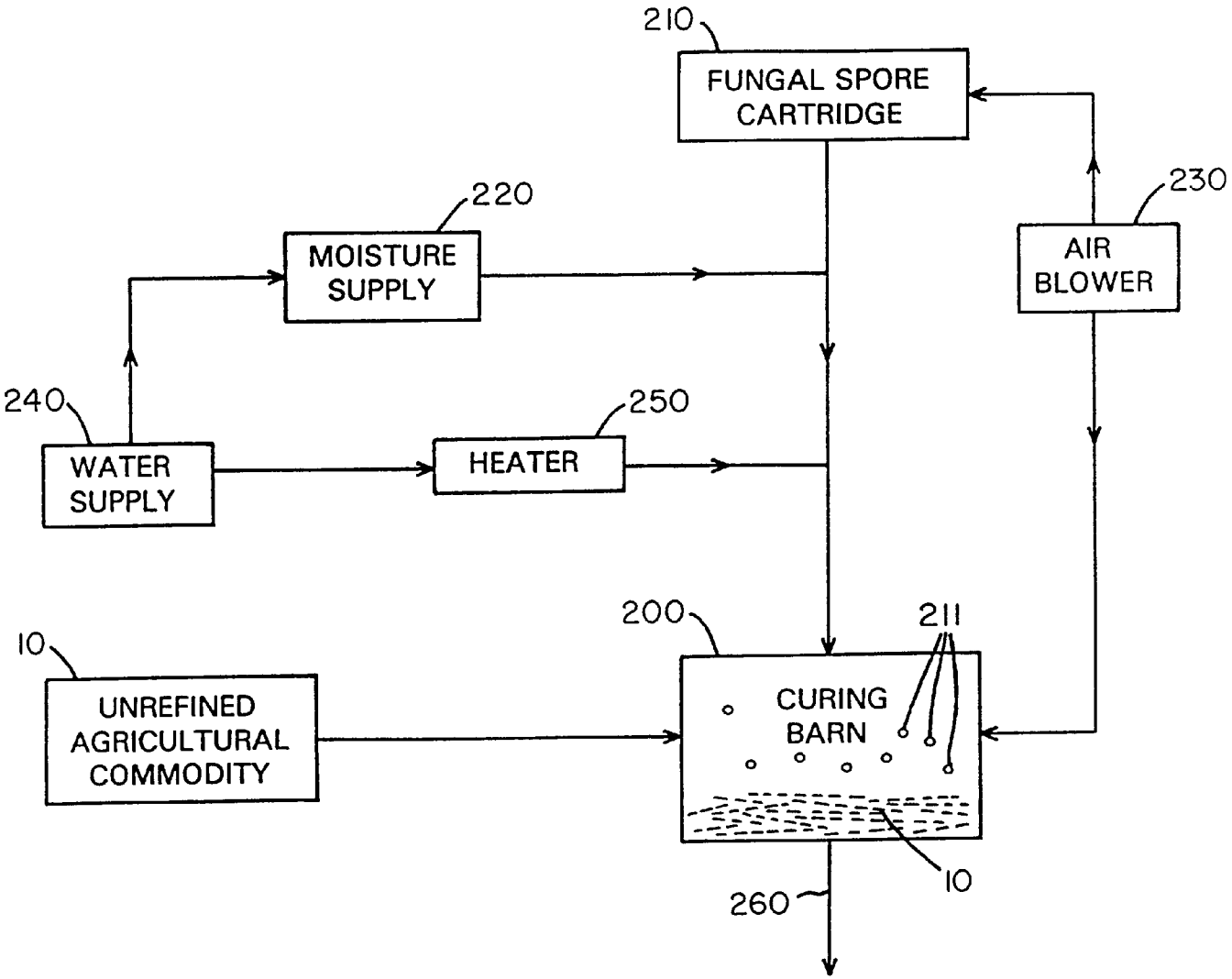
FIG. 2 is a schematic diagram of a representative apparatus for performing the process of the subject invention.

FIG. 2 shows in diagrammatic form an apparatus for treating product 10 to inhibit production of harmful microbes. (Step 11 in FIG. 1.) The product 10 is placed in a suitable treatment chamber 200, such as a curing barn. The product 10 may previously have been sterilized or otherwise treated as discussed above. A prepackaged cartridge 210 is provided to inject non-toxigenic benevolent fungal spores 211 into the chamber 200. The purpose of the benevolent fungal spores 211 is to crowd out harmful toxigenic microbes with a harmless species. The treatment is generally done in an enclosed semi-airtight chamber 200, but a curing barn may suffice. United States Patent to Cotty, entitled "Method for the Control or Prevention of Aflatoxin Contamination Using a Non-Toxigenic Strain of *Aspergillus Flavus*," U.S. Pat. No. 5.294,442, and United States Patent to Miller et al., entitled "Packaged Fungal Culture Stable to Long-Term Storage," U.S. Pat. No. 5,679,362, disclose a benevolent spore production device and their disclosure is hereby incorporated by reference as though set forth at length.

In FIG. 2, a moisture source 220, such as moistened sponges on rotating cylinders, is provided to aerosolize the spores 211 ejected from the fungal spore cartridge 210 and a blower device 230 is provided for blowing the fungal spores 211 from cartridge 210 through the chamber 200 so that benevolent fungal spores 211 are fully dispersed through out the chamber 200 and the product 10. A water bath 240 is provided for spore production and a heating device 250 for heating the water bath 240. If liquid distribution of aerosolized spores is desirable or necessary, a mist-generating apparatus (not shown) may be provided to provide a benevolent fungal spore bearing mist for distribution through out the chamber 200. A conveying device 260 is provided for conveying the product 10 from the chamber 200 for further processing.

As an alternative to the benevolent fungal spores discussed above, the chamber 200 may have a nitrogen generator (not shown) to provide an inert atmosphere in the chamber. One example of a nitrogen generator has a semi-permeable membrane that separates out nitrogen from air. Other nitrogen generators are known in the art and therefore are not discussed in detail here. A United States Patent to Ward entitled "Nitrogen Generator Process for the Production of Low Volumes of High Purity Nitrogen from Compressed Air." U.S. Pat. No. 4.572.723. discloses one example of a preferred nitrogen generator. In the instance of use of nitrogen, or other suitable inert gas, the chamber is airtight, purged of air, and the air is replaced with pure nitrogen from the nitrogen generator, or with another suitable inert gas. An inert atmosphere inhibits and/or prevents production of harmful fungal toxins. Pattee, Harold E., "Production of Aflatoxins by Aspergillus Flavus Cultured on Flue-Cured Tobacco." *Applied Microbiology* 1969; 18: 952–953. Preferably, the product 10 is stored in an airtight storage container that contains a minimal, but optimally, substantially zero amount of oxygen so as to prevent formation of toxins. Preferably, the product 10 is surrounded by an inert gas, generally, but not limited to nitrogen, to inhibit and prevent further toxin production.

As another alternative for inhibiting toxin production, the product 10 can be treated to inhibit production of microbes, as disclosed in U.S. Pat. No. 5,698,599, supra, the disclosure of which is hereby incorporated herein by reference in its entirety.

Refer again to FIG. 1, which shows that the product 10 is transported to a manufacturing facility 13, such as a cigarette manufacturing plant, and is preferably heated 20, for example, by steam, infrared irradiation, or microstate irradiation. U.S. Patent to lasch et al., entitled "Method of and Apparatus for Manipulating Bales of Condensed Tobacco Particles," U.S. Pat. No. 5,139,035, discloses methods of heating tobacco and its disclosure is hereby incorporated herein by reference as though set forth at length. Continuous monitoring 30 of the heated tobacco is performed to analyze vapors emitted from the product 10 for toxin content. In this, gas chromatography or gas/solvent immunoantibody fluorescence or any other suitable analysis technique may be used to analyze the vapors. United States Patent to Stahr entitled "Method of Detecting Mold Toxin Infected Grains," U.S. Pat. No. 4.314,027, discloses one suitable method to analyze vapors and its disclosure is hereby incorporated herein by reference in its entirety.

There are presently no guidelines for aflatoxin contamination with respect to tobacco products, but given the increasing incidence of all cancers associated with smoking, and the potency of aflatoxins, the process and system of the present invention provides for a substantially reduced concentration of this carcinogen, i.e., the mycotoxin is substantially eliminated from in-process product. Grossly contaminated product, i.e., product contaminated to such an extent that removal of contamination is impossible as a practical matter, is separated 40 and removed from further processing to be discarded or otherwise handled as appropriate. U.S. Pat. No. 4,991,598 to Henderson et al., entitled "Method of and Apparatus for Automatically Analyzing, the Degradation of Processed Leaf Tobacco." In-process product 50, which can be treated and processed effectively is retained for further processing and treatment.

Although, as discussed above, there are presently no guidelines with respect to mycotoxin contamination in tobacco, some guidance may be obtained from mycotoxin-contamination guidelines with respect to other agricultural products. For example, some state regulations ban foodstuffs and animal feed when aflatoxin contamination exceeds 200 to 300 parts per billion (ppb), the United States Food and Drug Administration (FDA) currently bans sale of foodstuffs when aflatoxin contamination exceeds 20 ppb, and milk is banned for human consumption when levels of aflatoxins exceed 0.5 ppb. However, it will be appreciated that in the main, experience will dictate to a skilled practitioner when threshold levels of mycotoxins in general, and in particular aflatoxins, are above critical levels, at which they cannot be practically removed from the product. In other words, the skilled practitioner knows when the commodity is grossly contaminated.

Once the in-process product 50 is acceptable for further processing, it may be prepared for processing 60 by treatments designed to volatilize, vaporize, heat, freeze dry, irradiate, wet, solubilize or provide other desired treatment before further processing begins. The nature and extent of such preparation 60 depends upon the product 50 and the treatments that are considered desirable or necessary for the product 50 before further processing. As a part of the preparation for processing 60, preferably individual sheets of product 50, i.e., tobacco leaves, are deposited 70 on a conveyor device such that a maximum amount of surface area of the product 50 is exposed. The preparation 60 may include slicing the product 50 with a sharp knife device, cutting it with a reciprocating or band saw, burning of sections with high-energy laser, etc., so as to expose a maximum surface area of the in-process product.

After the product 50 is deposited on a conveying device 70, the product 50 is exposed 80 to ultraviolet radiation to separate 90 uncontaminated in-process product 100 from contaminated product 110, as discussed in detail below. U.S. Pat. No. 4,866,283 to Hill, Jr., entitled "Optical Inspection of Food Products."

Generally, ultraviolet radiation in the range of, but not limited to, about 362 to about 363 nanometers is used for aflatoxin detection. Exposure of aflatoxins in particular to ultraviolet radiation results in optical fluorescence at about 425 to about 450 nanometers which can be seen by the naked eve in a darkened environment. Similarly, other mycotoxins may be detected using ultraviolet radiation having frequencies specific to the particular mycotoxins. As is generally known, different species of mycotoxins have associated excitation-emission frequencies. Detection of such mycotoxins using their associated excitation-emission frequencies is within the scope of the present invention. Moreover, various other types of harmful carcinogenic compounds present in tobacco and tobacco products may also be removed using their excitation-emission frequencies as shown in Table 1.

TABLE 1

Excitation-Emission Maximums for Various Polynuclear Aromatic Hydrocarbons

| Polynuclear Aromatic Hydrocarbons | Excitation | Emission |
|---|---|---|
| Pyrene | 331 | 384 |
| Phenanthrene | 248 | 365 |
| Fluoranthrene | 284 | 454 |
| Anthracene | 248 | 395 |
| Chrysene | 262 | 377 |
| Benzo(a)pyrene | 378 | 400 |
| Benzo(a)anthracene | 282 | 385 |
| Benzo(c)phenanthrene | 275 | 390 |
| Benzo(b)fluoranthrene | 295 | 426 |
| Benzo(j)fluoranthrene | 313 | 498 |
| Benzo(g,h,i)perylene | 295 | 415 |
| Methylcholanthrene | 291 | 414 |
| Dibenz(a,h)anthracene | 280 | 380 |

The optical fluorescence emitted may be detected by devices such as electronic-image intensifiers, enhancers coupled with charged coupled devices. etc. Preferably, the devices for detecting optical fluorescence are connected to a computer programmed for controlling other devices that separate 90 uncontaminated in-process product 100 from contaminated product 110. In this, devices that can be controlled by a computer for separating contaminated product include, but are not limited to, a swinging or extending sweeping-arm device, which sweeps contaminated product into a waste bin or onto a second conveyor running at any desired angle and in any direction relative to a first conveying device. In addition, a blast of air may be used for separation of contaminated product to another conveyor and a vacuum device may be used for sucking up the contaminated product.

Figure 3:
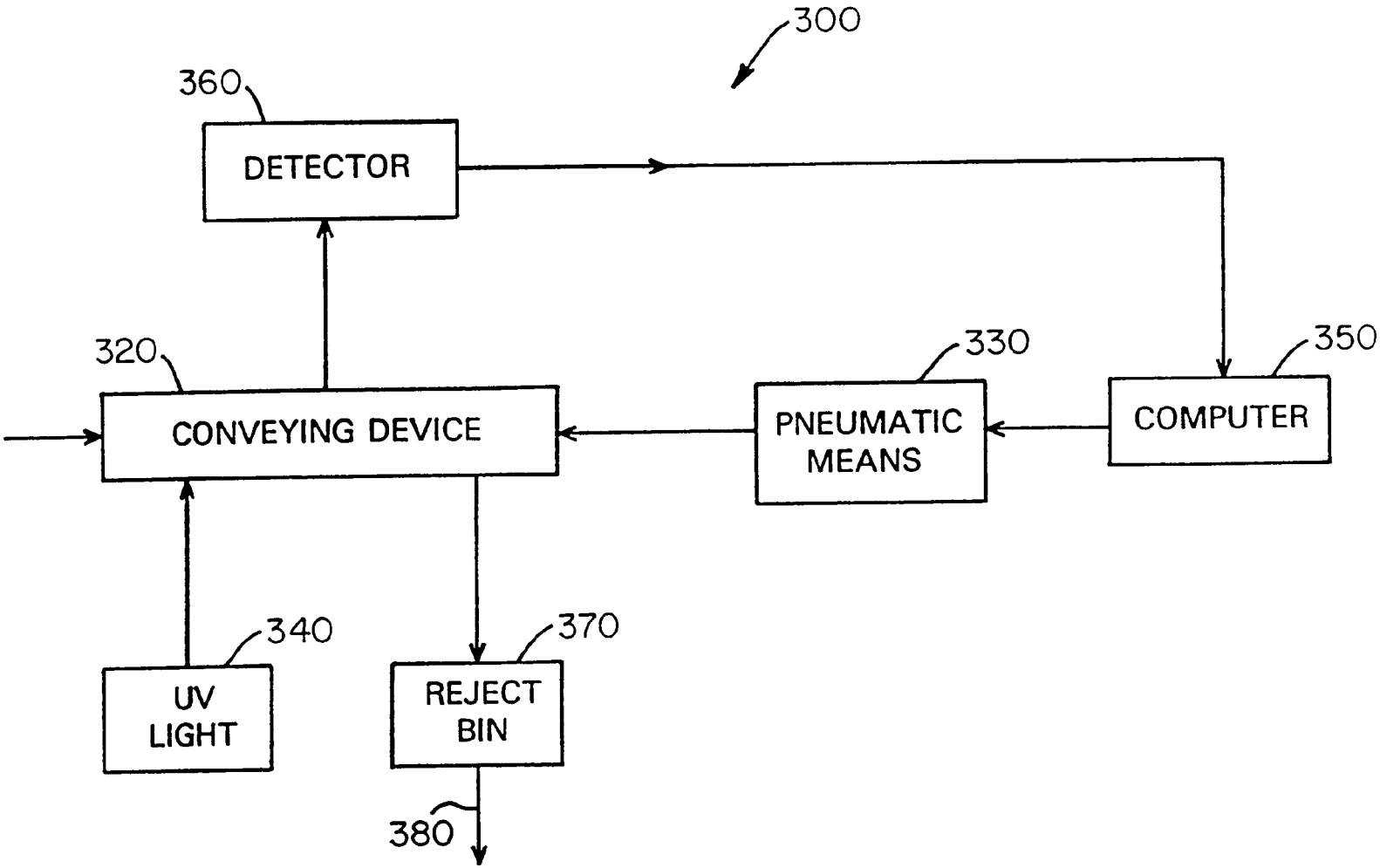
FIG. 3 is a schematic diagram of another representative apparatus for performing the process of this invention.

FIG. 3 shows in block-diagram form a preferred embodiment of a system 300 for exposing product 50 to ultraviolet light and separating contaminated product 110 (steps 80 and 90 in FIG. 1). A loading device 310 conveys in-process product 50 to a conveying device 320 having means 330 for applying negative pneumatic pressure, i.e., a suction device. The product 50 is retained on the conveying device 320 and is carried thereon while being exposed to ultraviolet radiation from an ultraviolet light source 340 of a specific frequency. The ultraviolet light source may be a laser operable for producing ultraviolet light. In one embodiment, the laser may be a laser diode. Preferably, the conveying device 320 is made of a material that is optically transparent to ultraviolet light so that the product 50 may be exposed to ultraviolet light 340 from top and bottom. A computer 350 controls pneumatic device 330 so that when toxin contamination is detected by fluorescence detector 360 the pneumatic pressure of the pneumatic device 330 is reversed, i.e., a blower device, and contaminated product 110 is blown off the conveying device 320 into a reject bin 370. The fluorescence detector 360 is connected with the computer 350, which controls separation of contaminated material from uncontaminated commodity. Uncontaminated in-process product 100 is retained on the conveying device 320 and carried away for further processing into an end product, such as cigarettes. The contaminated product 110, however, is carried from the bin 370 by conveying means 380 for appropriate disposal. In a preferred embodiment of the system 300, the conveying device 320 is a conveyor belt or screw conveyor, or any other suitable conveyor apparatus, and is made of a clear material that is optically transparent to ultraviolet light. Optical radiation is easily transmitted through the device 320 to allow detection of contamination on both upper and lower surfaces of the product 50, thereby increasing efficiency and accuracy in selecting and separating contaminated product from the production line. A similar result may also be obtained by blowing the in-process product 50 over a glass plate irradiated with a desired optical radiation.

Tobacco is prone to aflatoxin contamination when stored in the open and wet by rain. In this the system 300 may advantageously be used to continuously expose tobacco carried by optically transparent screw conyeyors, augers, or belts to ultraviolet radiation of a specific frequency.

Figure 4:
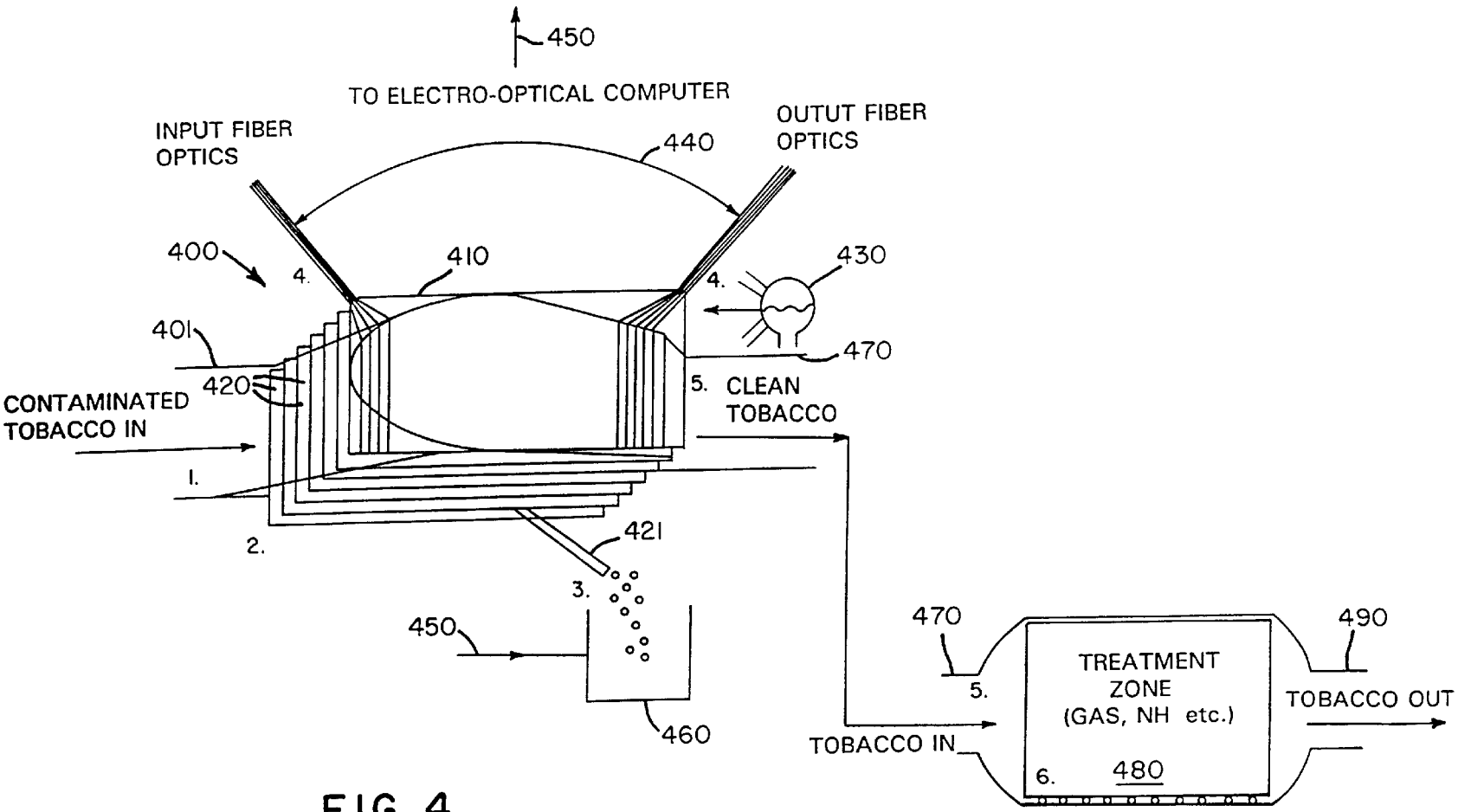
FIG. 4 is a schematic diagram of yet another representative apparatus for performing the subject process.

FIG. 4 shows an apparatus 400 for sorting tobacco (steps 80 and 90 in FIG. 1) having a clear, transparent chamber 410 and a conveying device 401 for conveying in-process tobacco to the chamber 410. A number of channels 420 in the chamber 410 have openings 421 at the bottom for gravity separation of contaminated product from uncontaminated product. Preferably, the channels 420 in the optically transparent chamber 410 are parallel to each other and are separated by a minimal amount of distance so that in-process product in the channels 420 passes through the channels 420 with each surface being exposed to UV radiation from an ultraviolet light source 430 of specific frequency. This arrangement enhances detection of toxin contamination and ensures that contaminated tobacco does not pass through undetected. Preferably, a plurality of fiber-optic illumination and receiving fibers 440 are placed in the transparent panels of the chamber 410, making the unit 400 compact and eliminating need for bulky UV light sources between the clear panels. A computer 450 connected with the fiber-optic strands 440 controls the bottom openings 421 of the channels 420 to eject contaminated product into a reject bin 460. A conveying device 470 carries uncontaminated product out of the chamber 410, preferably to another treatment chamber 480 for treating the uncontaminated product with a suitable treatment gas, such as, for example, ammonia ($NH_3$), to remove or treat any toxin contamination remaining undetected in the preceding chamber 410 and to inhibit production or reformation of harmful toxins. Another conveying device 490 carries treated product out of treatment chamber 480 for further processing, if desirable or necessary.

Refer again to FIG. 1, which shows that a solvent 120 for removing toxins is contacted and agitated 130 with in-process product 100. Solvents considered particularly suitable for use in the subject invention include aqueous solutions having adjunct solvents added to facilitate separation of toxins such as acids, bases, oils, detergents, fatty acids, esters, emulsifiers; organic-based solvents, including ethers, ethanol, methanol, chloroform. dichloromethane; other alcohols, ammonia, bleaches, hydrogen peroxide, polyethyleneglycol, amines, methylamines, hydroxides of salts, formalin, ozone; or other solvents or solutions. Reagents that cause the toxins to separate as precipitates, as well as solvents that solubilize the toxins, are considered within the scope of the invention. Tobacco-processing solvents and solvents used to extract mycotoxins, such as aflatoxins, during processing regimens are numerous and, in many respects, the same. For example, alcohols may be used, in particular methanol and ethanol. Halogenated hydrocarbons, ethers, and other wetting agents may also be used. Liquid carbon dioxide may also be used as a solvent.

Mycotoxins, and in particular aflatoxins, are removed by contacting and agitating 130 the in-process product with a suitable solvent 120, separating contaminants 140 from the product, and then removing the toxins as a suspension in extracted solvent 150. Typically, product 100 is contacted with a suitable solvent or solvents, and the mixture is then physically agitated by stirring, shaking, subjecting to ultrasonic cavitation, or any other similar agitation process, to physically separate any contaminants from the in-process product. Preferably, the solvent-product mixture is tested for toxin level prior to treatment and then is subjected to intermittent or continuous ultrasonic cavitation (U.S. Pat. No. 5,498,431 to Lindner, entitled "Decontamination and Detoxification of Cereals Contaminated with Mycotoxins") and ultraviolet illumination (U.S. Pat. No. 5,194,161 to Heller et al., entitled "Niaterials and Methods for Enhanced Photocatalyzation of Organic Compounds with Palladium") until such time that the extracted solvent 150 no longer contains a significant level of toxins, as discussed in further detail below. Solvent treatment of in-process product and continuous monitoring of extracted solvent streams ensures that even minute quantities of contaminants, which would otherwise escape detection, are eliminated from in-process product, thereby ensuring that end products, such as cigarettes, are free of harmful toxins.

Toxin levels in extracted solvent streams 150 are continuously monitored 160 to detect levels of toxins present prior to treatment and remaining in the product 100. For example, solvent streams extracted from the solvent-product slurry mixture are filtered, clarified, or otherwise rendered relatively optically transparent, such that the solvent streams can then be subjected to ultraviolet radiation, in particular to monitor for aflatoxins. U.S. Pat. No. 4,285,698 to Otto et al., entitled "Analysis of Aflatoxins in Peanuts by High Pressure Liquid Chromatograph." Preferably, the solvent streams are passed through an immunoaffinity column, or clay-type filtration column, to clean up other contaminants in the solvent streams so that aflatoxins in the solvent streams may be better detected. Stubblefield, R. D., J. I. Greer, O. L. Shotwell, and A. M. Aikens, "Rapid Immunochemical Screening Method for Aflatoxin $B_1$, in Humans and Animal Urine" *JOAC* 1991: 74: 530.

A number of alternative assaying techniques may be used to continuously or intermittently monitor levels of toxins. These assaying techniques include, but are not limited to, high-pressure liquid chromatography (HPl C), reversed-phase liquid chromatography, thin-layer chromatography, radioimmunoassay (RIA), antibody-linked RIA, ELISA, spectrophotometry, mass spectrophotometry, infrared spectroscopy, raman spectroscopy, lyophilized ligand-receptor complexes for assays and sensors, packed-flow cell fluorescence liquid chromatography (PFCFLC), antibody-linked immunoassay, adsorption chromatography, immunoaffinity chromatography, supercritical fluid extraction, bio-luminescence, chemical luminescence, and others.

Preferably, the extracted solvent streams 150 may be irradiated with optical radiation of a desired wavelength delivered and/or sensed through a fiber-optic device. In this, continuous assay of effluent streams involves use of fiber-optic fibers or strands to carry and receive optical radiation used in the toxin identification process. The illumination apparatus may be located at a considerable distance from the point of solvent stream toxin identification. Advantageously use of fiber optics allows a plurality of wavelengths of light in close proximity to each other to be used for multiple toxin identification, and for a plurality of receiving fiber strands to be placed adjacent to each other, if necessary or desirable. The fiber optics may advantageously be mated to an electro-optical processing unit such that incident optical radiation is converted into an electrical analog or digital data stream and the data is then transmitted electrically to a computer processing unit. In this, a liquid or gaseous effluent-solvent stream is illuminated at various specific frequencies and the reflected fluorescing radiation is transmitted back to a central computer. A program or algorithm designed to signal the presence of predetermined levels of toxins or other undesirable chemicals is preferably used to monitor levels of toxins in the effluent streams at or in excess of preset levels. Once the alert to excessive levels of toxin contamination is given, further treatment steps can be effected, possibly resulting in total rejection of an entire batch if treatment and removal of toxins cannot be reliably achieved.

Refer again to FIG. 1, which shows that remediation 170 of contaminants in extracted solvents 150, used to extract, treat, or remove toxins from in-process product 100, is provided. Such treatments include, but are not limited to, acidification, oxidation, reduction, peroxidation, ammoniation, addition of a base, dilution, microwave irradiation, nuclear irradiation, ozonation, ultraviolet irradiation, proton-exchange membranization, heating, cooling, saponification, precipitation, condensation, chemical alteration or ultrasonic cavitation.

Tobacco processing currently used in manufacturing reformulated tobacco product involves a series of steps designed to separate tobacco leaves from certain pharmacologically active substrates, especially nicotine. The tobacco processing steps (lien continue, and certain components of tobacco such as flavorings and likely carcinogens are extracted out. The tobacco product is then treated further, and at some point, nicotine and/or other extracts may be added back into the nearly finished product. Preferably, any extracts added back into the in-process tobacco are tested for toxins and treated, if necessary.

As aflatoxins are deadly poisons, it is not adequate to merely treat to remove them without knowing the level of contamination before treatment and what remains after treatment. The process and system of the present invention treats toxins in effluent solvent streams, and other potential additives, as a quality control measure, especially to prevent reintroduction of contaminants back into the in-process tobacco. The remediated solvent, or tested and treated additives, may be reused 171, or at least safely disposed of 172, when the level of contamination is known. In this, the process and system of the invention quantifies the levels of toxins in the effluent streams, thus indirectly revealing the level of toxins remaining on the tobacco, especially when the solvents separate the toxins from the tobacco with great avidity. For remediation of a solvent stream identified as toxin-tainted, a computer can be programmed to institute appropriate treatment regimens, which are effected as quickly, and economically as possible. The process and system continues treatment until such time as the solvent stream is deemed as safe as possible.

The in-process product is treated 180 near the end of its treatment/manufacturing process, but not necessarily as a last step, to prevent reformation of toxins. Ammoniation of smoking compositions has been shown to decrease biological activity. U.S. Pat. No. 3,631,865 to Michelson, entitled "Smoking Composition of Reduced Toxicity and Method of Making Same." The reformation typically occurs when the pH of the processed product changes at the end of the process. For example. addition of gaseous or liquid ammonia ($NH_3$) may be used to protect decontaminated tobacco from recontamination by reformation of aflatoxins. Additionally, processed product could advantageously be packaged within an airtight container that contains an inert gas, such as nitrogen, which prevents growth of toxins, or ammonia ($NH_3$), which prevents reformation of toxins on the finished product.

Figure 5:
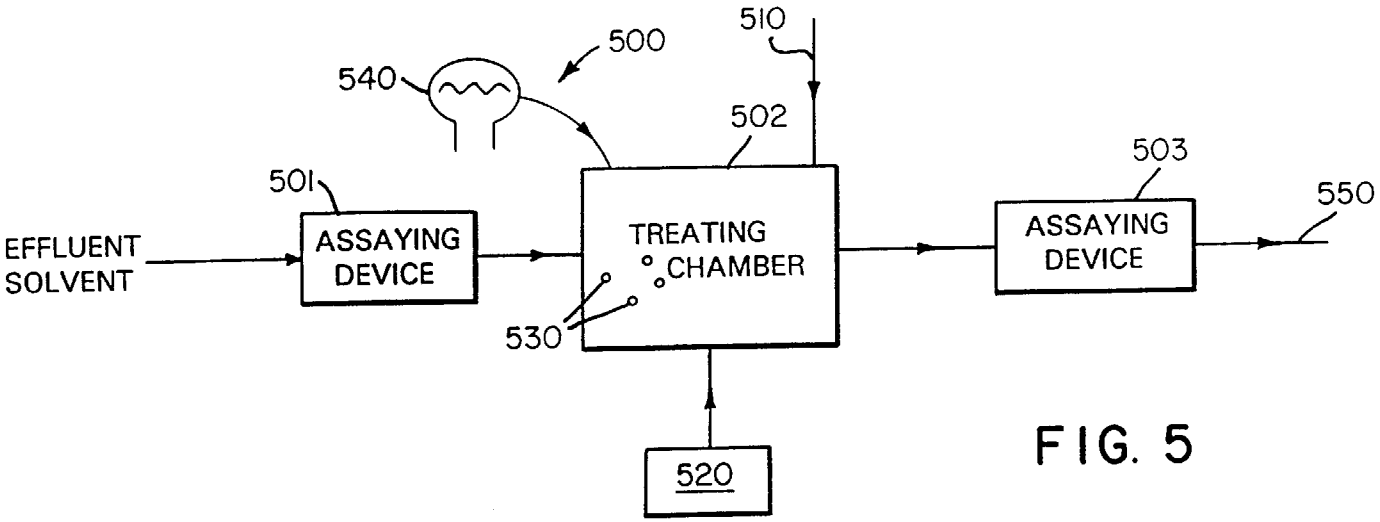
FIG. 5 is a schematic diagram of yet another representative apparatus for performing the process in accordance with the invention.

FIG. 5 shows in diagrammatic form an apparatus 500 for continuous assay of effluent solvent streams and remediation of solvent streams to decontaminate harmful toxins separated from in-process product 100. (Steps 160 and 170 of FIG. 1.) Effluent solvent derived from treatment of product 100 is delivered to a solvent assaying device 501.

Figure 6:
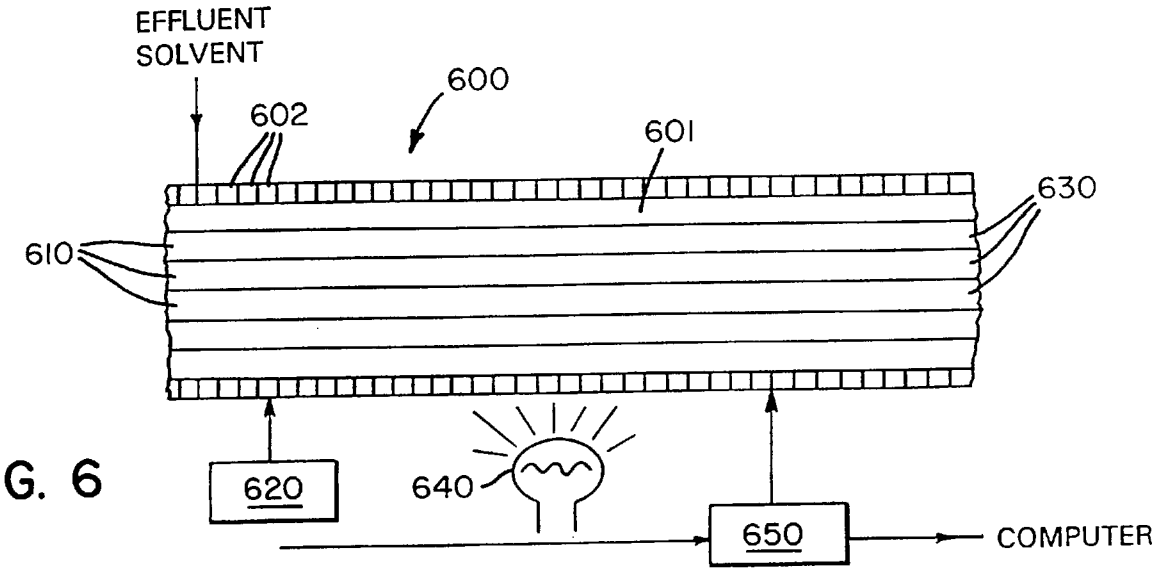
FIG. 6 shorts an embodiment of a continuous assay device for performing the process of the invention.

FIG. 6 shoes one preferred embodiment of a solvent-assaying device according to the present invention having a continuously moving transparent strip 600 comprising a substrate 601 with slots 602 therein arranged longitudinally along the strip 600, for example, similar to a 35 mm photography film. U.S. Pat. No. 4,071,315 to Chateau entitled "Analytical Tape Medium." A plurality of mycotoxin-specific antibodies 610 are provided on the substrate 601 extending longitudinally along the strip 600. U.S. Pat. No. 4,168,146 to Grubb et al., entitled "Immunoassay with Test Strip Having Antibodies Bound Thereto." When the strip 600 is exposed to a continuous effluent solvent stream, toxins present in the effluent solvent adhere to the antibodies 610 on the strip 600 specific to the toxins in the solvent. The strip 600 may be contacted with effluent solvent, for example, by dripping the solvent, brushing it, or otherwise contacting the effluent solvent with the strip 600.

The strip 600, after exposure to effluent solvent, preferably has fluorescent probes 620 attached chemically to the toxin-antibody complex forming toxin-specific antibody fluorescent probe complexes 630. U.S. Pat. No. 4,036.946 to Kleinerman, entitled "Immunofluorometric Method for Measuring Minute Quantities of Antigens, Antibodies and Other Substances." The strip 600 with the complexes 630 is exposed to ultraviolet light 640 having a wavelength that is specific to the fluorescent complex to be identified. The radiation emitted is measured and quantified by a detector 650, advantageously connected to a computer, to yield a continuous assay of toxins in the effluent solvent, and therefore, the toxins present in the in-process product 100. The product 100 is retreated with solvent till such time that it meets acceptable standards for toxin content. In this, by use of the strip 600 an in-process product can be tested simultaneously and continuously for 5 to 10 different toxins. Advantageously, a control or pilot antibody strip (not shown) specific to a control chemical in the effluent stream is provided on the strip 600 to verify that the strip 600 is properly exposed to the effluent stream. U.S. Pat. No. 4,772,551 to Hart et al., entitled "Method and Test Kit for Detecting A Trichothecene Using Novel Monoclonal Antibodies"; and U.S. Pat. No. 4,835,100 to Dixon et al., entitled "Method and Test Kit for Detecting an Aflatoxin $B_1$, and $G_1$ Using Novel Monoclonal Antibodies."

Figure 7:
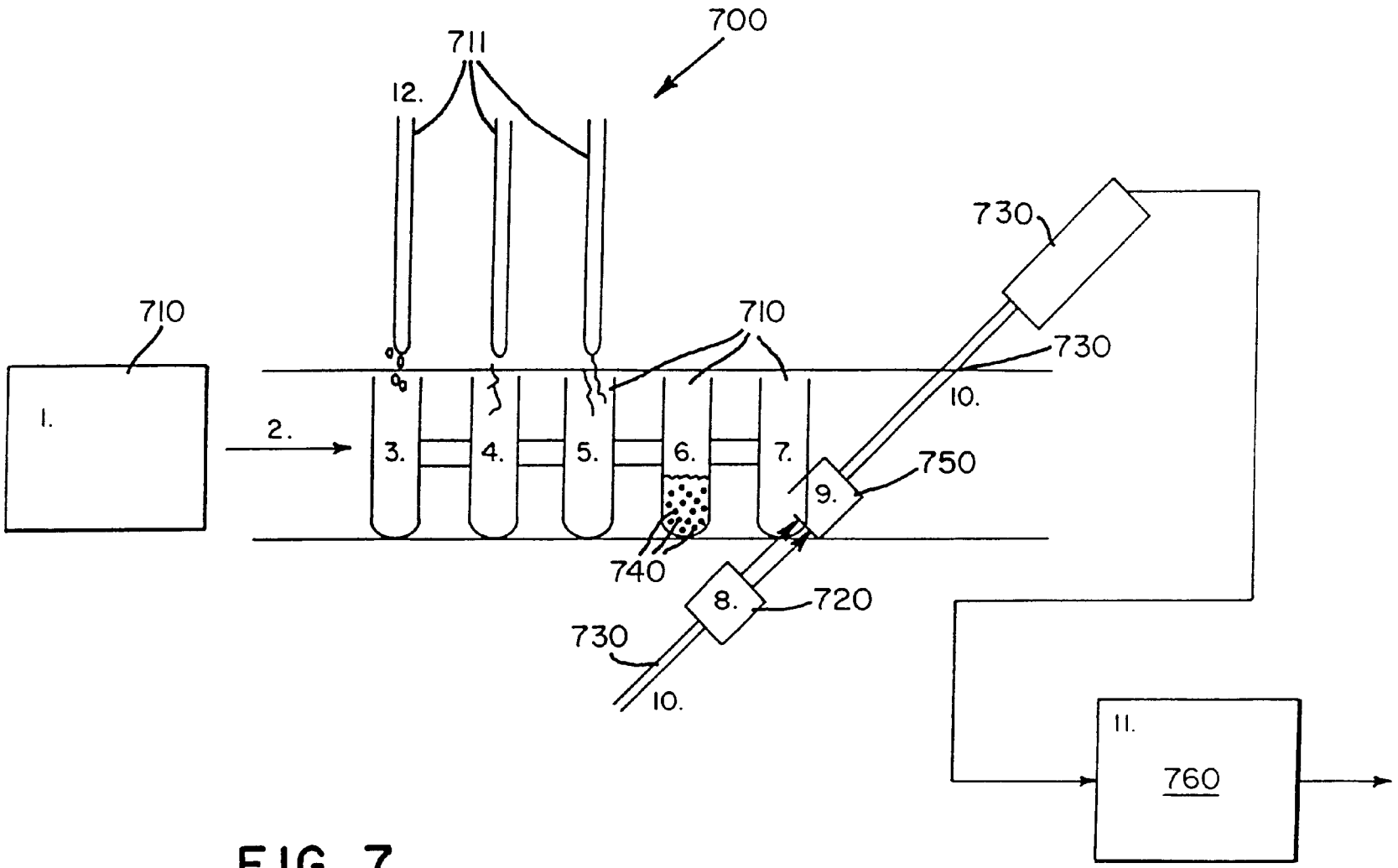
FIG. 7 shows another embodiment of a continuous assay device for performing the process of the invention.

FIG. 7 shows another preferred embodiment of a solvent assaying device according to the present invention having a continuous solvent testing device 700 with automated, continuously moving transparent cuvettes 710; for example, cuvettes or cells continuously unwound from a roll using suitable means. Inlet means 711 are provided for delivering effluent solvent and other assaying agents described below into the cuvettes 710. U.S. Pat. No. 3,763,374 to Tiffany et al., entitled "Dynamic Multistation Photometer-Fluorometer." Laser produced ultraviolet light 720 is transmitted by fiber-optic cable 730 (U.S. Pat. No. 3,992,631 to Harte, entitled "Fluorometric System, Method And Test Article") to illuminate, for example, aflatoxin-specific antibody-coated beads 740 in the cuvettes 710. The toxin-specific antibody-coated beads 740 may be coated with antibodies specific to any toxin that is to be detected. The beads 740 are contacted with effluent solvent, which is introduced in the cuvettes 710 via inlets 711. The antibody bead-cuvettes 710 preferably use fluorescent probes, which, when combined with antibodies for specific toxins, will fluoresce even if the toxin in question does not fluoresce well or at all. An accelerator reagent may be used, if desirable or necessary, and the cuvettes 710 may be agitated, heated or otherwise treated to enhance assay sensitivity, as with addition of a cyclodextrin, Cepeda, A., et al., "Postcolumn Excitation of Aflatoxins Using Cytclodextrins in Liquid Chromatography for Food Analysis." *Journal of Chromatography,* 1996; 721: 69–74.

The fiber-optic apparatus 730 transmits fluorescent radiation, detected by detecting means 750, such as, for example, an image enhancer or intensifier device, to an electro-optical computer or evaluation unit 760. If a light source that consists of a plurality of wavelengths is used, a filter may also be used to screen out or eliminate undesired optical radiation from being transmitted to the optical-radiation computer. Preferably, optically transparent cuvettes are used to hold the testing complex, and the cuvettes may move sequentially in an automated-testing regimen. The automated testing regimen may advantageously use a circular spinning tray to hold samples, or may consist of a continuous strip of test wells that move into the testing zone. Test cuvettes may be preloaded with toxin-specific antibody fluorescent probe complexes (TSAFPC) (Haugland, Richard P., *Handbook of Fluorescent Probes and Research Chemicals*, Sixth Ed. Molecular Probes, Inc., Eugene. Oreg. 1996) with presealed needle-penetrable rubber stoppers, or test cuvettes may be loaded with toxin-specific antibody fluorescent probe complexes (TSAFPC) through inlet means 711 just prior to testing a solvent sample. An advantage of point of testing loading (POTL) of cuvettes is that the desired test may be chosen by a suitably programmed computer depending on the anticipated or suspected toxin and quantities present.

The toxin-specific antibody fluorescent probe complexes (TSAFPC) may be coated onto transparent microspheres of various sizes to obtain optimal fluorescence, thereby enhancing detection sensitivity. The TSAFPC-coated microspheres may be used in test cuvettes, as described above. Alternatively, the TSAFPC-coated microspheres may be affixed to a suitable substrate and used in the manner described above in connection with FIG. 6. Moreover, as another embodiment, the TSAFPC-coated microspheres may be introduced into a flowing solvent stream, captured by a restrictive or screen-type device, and illuminated with suitable optical radiation, and thereby, assayed. U.S. Pat. No. 4,181,853 to Abu-Shumays et al., entitled "Liquid Chromatography System With Packed Flow Cell For Improved Fluorescence Detection"; and U.S. Pat. No. 5,322,799 to Miller, Robert J. and James D. Ingle, entitled "Observation Cell And Mixing Chamber."

In addition, mirrors and filters may be used, if desirable or necessary, to optimize detection of the optical radiation by the fiber-optic detection unit. Another feature of the process and system relates to alignment of the solvent-containing tubes or cuvettes 710 and the fiber-optic illumination cables 730 and/or receiving detector 750 so that optical radiation is optimized.

Refer again to FIG. 5 which shows that after continuous assay of effluent solvent and quantification of levels of toxins in the solvent, the solvent is remediated in treatment chamber 502 of apparatus 500. Treatment gas/solvent is provided via input means 510, and preferably, an ultrasonic transducer/cavitator device 520 is used to promote remediation of the effluent solvent. Preferably, neutrally buoyant palladium, or other suitable catalyst-coated spheres 530 are provided in the treatment chamber to enhance cavitation treatment. In this, palladium-catalyst coating is in the range of about 0.001 to about 3.0 percent by weight. Advantageously, the spheres 530 have diameters in the range of about 30 to about 100 nanometers. Advantageously, an ultraviolet light source 540 is provided for biocidal treatment of the effluent solvent. In this, ultraviolet light in excess of about 10 watts/meter$_2$ is an effective biocide and enhances catalytic degradation of toxins. U.S. Pat. No. 5,194,161 to Heller et al., supra, discloses materials and methods for enhanced photocatylization of organic compounds with palladium and said disclosure is hereby incorporated herein by reference in its entirety. Typically, aflatoxin contaminants of agricultural commodities are remediated by contacting the products with an ammonia-based solution or gas. U.S. Pat. No. 5,082,679 to Chapman, supra. After remediation, the remediated effluent solvent is once again assayed using another assaying device 503, which preferably is one of the assaying devices described above. Outlet means 550 removes remediated solvent for further remediation, if desirable or necessary, or for reuse or safe disposal, as desired.

In addition to mycotoxins, tobacco contains at least some 40 other carcinogens, the prototypical being benzpyrene and its precursors and its congeners, which have their own specific excitation-emission frequencies and are thus subject to detection and remediation. Fungi known in particular to contaminate tobacco are the species fusarium, which produce zearealone, an estrogenic carcinogen. Aspergillus ochraeus can produce a mycotoxin known as ochratoxin, which is both a nephrotoxin and promoter of lung tumors. A variety of fungi regularly inhabit tobacco, depending on the microenvironment, and many are known to produce mycotoxins. Other compounds, such as tobacco-specific nitrosamines, may be detected by optical fluoroscopy in solvent streams, and as such are amenable to a treatment process to remove them.

SUMMARY OF MAJOR ADVANTAGES OF THE INVENTION

After reading and understanding the foregoing detailed description of a process and system for continuous assay and elimination of toxins, in accordance with preferred embodiments of the invention, several distinct advantages of the subject process and system are obtained.

The present invention provides a novel process and apparatus for detecting and removing harmful toxins found in tobacco and tobacco products by continuously detecting, monitoring and removing harmful mycotoxins, such as aflatoxins, and benzpyrene and its precursors during processing of tobacco for human and animal association, consumption and use. The novel process and apparatus provides for inhibiting production of mycotoxins in and on tobacco and tobacco products, and for continuous monitoring and removal of harmful toxins from solvent and gaseous-effluent streams arising from processing tobacco. This continuous assaying and monitoring is necessary to ensure adequate removal and continuous diminution of harmful toxins from tobacco and tobacco products and to ensure that the products are safe for human consumption.

Treatment of tobacco to eliminate immunosuppressive carcinogens is of critical importance. Monitoring the tobacco production process to ensure continuous diminution is of equal importance. A failure to adequately monitor, treat and remove these harmful toxins could result in their continued presence in tobacco and tobacco products, with attendant negative public-health consequences. In contrast with prior art processes, the process and system of the present invention continuously assays and treats in-process tobacco to ensure adequate removal and continuous diminution of harmful toxins from tobacco and tobacco end products.

The process and system of the invention assays and verifies multiple toxins in tobacco, and in processing-extraction streams, for treatment and removal, to ensure that processed end products, and in particular cigarettes, and effluent streams, do not contain dangerous levels of the toxins. The invention provides for optical fluorescence of in-process tobacco solvent-streams, in combination Faith other confirmatory qualitative or quantitative tests, to correlate the optical fluorescence with tests that are traditionally more definitive, thereby increasing the accuracy and sensitivity of detection and assaying of harmful toxins. For example, if a fast-flowing solvent stream is fluorescing markedly for a particular toxin, minimal amounts of solvent are withdrawn or extracted from the solvent stream for further testing by techniques such as high-pressure liquid chromatography (HPLC), reversed-phase liquid chromatography, thin-layer chromatography, adsorption chromatography, immunoaffinity chromatography, ELISA, fluorescent immunoassay, gas chromatography, mass spectroscopy, infrared spectroscopy, raman spectroscopy, packed-cell fluorescent spectroscopy, radioimmunoassay, polymerase chain reaction (PCR), electron-capture decay (ECD), supercritical fluid extraction, bio-luminescence, chemical luminescence, or any combination thereof.

In the flexibility and wide range of alternatives provided for detection of multiple toxins, the advantages of such a feature are numerous. This continuous monitoring and assaying of contaminants provides an ongoing quality control of the decontamination process, ensuring that harmful toxins and other contaminants in end products do not rise above generally acceptable levels. Effluent solvents derived from processing tobacco are also analyzed for toxin content, and are treated before reuse or disposal to reduce, minimize, or eliminate the toxins.

Inherent flexibility and adaptability of the process and apparatus provide for continuous or intermittent assay of mycotoxins, and in particular aflatoxins, benzpyrene and its precursors, and other contaminants, such as pesticides, biotoxins or any other undesirable toxins or agents that may threaten human or animal health. Of particular concern are smokers and individuals who inhale secondhand or environmental tobacco smoke. Tobacco is treated while being processed to remove such contaminants. Levels of contaminants in solvents, gases, and other process agents used to process tobacco, and in tobacco additives, are continuously monitored and controlled to provide a comprehensive, dependable solution to a grave problem that these dangerous contaminants pose to human and animal safety. As a part of this comprehensive approach to the problem, a tobacco product near the end of its treatment process, but not necessarily at the last step, is treated to prevent reformation of toxins on or in the tobacco.

Without attempting to set forth all of the desirable features of the instant process and system for continuous assay and elimination of toxins, at least some of the major advantages include the following: After removal of any tobacco that is excessively contaminated, the in-process tobacco is treated by a suitable process to remove toxins, including but not limited to solvent immersion, aqueous immersion, gasification, heating and cooling by any means, etc. These initial steps eliminate gross contamination, if any, and are followed by continuous analysis of extracted gases, solvents, liquids, vapors, and/or solids for toxins, to provide in-process quality control. Toxin levels are continuously and accurately monitored as the tobacco is treated, and harmful toxins present on or in the tobacco are removed, neutralized, or otherwise taken out of the end products. In a novel embodiment of the instant invention, this simultaneous quality-control monitoring system ensures that if a particular processing step is not sufficient to remove toxins, the step can be repeated or the product in question can be discarded, retreated, reformulated or otherwise modified so that it meets required standards insuring a safe end product.

In a comprehensive and global solution to the contamination problem, solvents gases and vapors eluted in various treatment steps are further treated to remove dangerous toxins from the elution stream so that the solvents, gases and vapors can safely be reused without recontaminating the product, or if desired. Safely disposed of without placing harmful toxins in the wastewater stream. Such decontamination processes include. but are not limited to acidification, ammoniation, saponification, irradiation, proteolysis, ozonation, cavitation, sonoluminescence, precipitation, alkalization, chemical neutralization by any means, not excluding heating, cooling, freezing or high temperature pyrolisis, among others.

The instant process and system provides for analyzing and treating re-additives to in-process tobacco so that they do not inadvertently reintroduce harmful toxins back into the cleaned and reformulated product. Current tobacco reformulation technology involves removal of extracts, flavorings, nicotine, etc., in early processing steps and returning them back into the tobacco near the end of the processing scheme as re-additives. These additives, like the solvents used to clean and extract toxins, are subjected to the same continuous or intermittent sampling for toxins and are cleansed of toxin contamination by means similar, but not limited, to those listed above.

In describing the invention, reference has been made to preferred embodiments and illustrative advantages of the invention. Those skilled in the art, however, and familiar with the instant disclosure of the subject invention, may recognize additions, deletions, modifications, substitutions and other changes that fall within the purview of the subject invention.

What is claimed:

1. A process of neutralizing aflatoxin on tobacco comprising:

(a) treating tobacco with a process to remove aflatoxin;

(b) assaying a tobacco sample taken from the tobacco treated in the prior step to determine its aflatoxin level; and (c) determining if the aflatoxin level exceeds a predetermined level and if the aflatoxin exceeds that level then the steps are repeated until that predetermined level, or less, is achieved.

2. A process of neutralizing aflatoxin on tobacco as defined in claim 1 wherein said assaying step comprises:

a process selected from the group consisting of high pressure liquid chromatography, reversed phase liquid chromatography, thin layer chromatography, adsorption chromatography, immunoaffinity chromatography, ELISA, fluorescent immunoassay, gas chromatography, mass spectroscopy, infrared spectroscopy, packed cell fluorescent spectroscopy, bio-luminescence, chemical luminescence, radioimmunoassay, polymerase chain reaction, supercritical fluid extraction, laser illumination, and any combination thereof.

3. A process of neutralizing aflatoxin on tobacco as defined in claim 1 or 2 in which:

said assaying step is performed prior to said first treating step and if the aflatoxin level is below said predetermined level then the tobacco is not treated to neutralize aflatoxin.

4. A process of neutralizing aflatoxin on tobacco as defined in claim 1 or 2 and further comprising:

if the aflatoxin level is above a discard threshold then the tobacco is removed from further processing.

* * * * *